US009334468B2

(12) United States Patent
Sunder et al.

(10) Patent No.: US 9,334,468 B2
(45) Date of Patent: May 10, 2016

(54) GRANULAR WASHING, CLEANING OR TREATMENT AGENT ADDITIVE

(71) Applicant: Henkel AG & Co. KGaA, Duesseldorf (DE)

(72) Inventors: Matthias Sunder, Duesseldorf (DE); Mario Sturm, Leverkusen (DE); Tobias Segler, Duesseldorf (DE); Andreas Bauer, Kaarst (DE); Walter Heberlein, Vienna (AT); Franz Pfeifer, Vienna (AT); Matthias Luecken, Vienna (AT)

(73) Assignee: Henkel AG & Co. KGaA, Duesseldorf (DE)

( * ) Notice: Subject to any disclaimer, the term of this patent is extended or adjusted under 35 U.S.C. 154(b) by 99 days.

(21) Appl. No.: 13/622,523

(22) Filed: Sep. 19, 2012

(65) Prior Publication Data

US 2013/0017987 A1 Jan. 17, 2013

Related U.S. Application Data

(63) Continuation of application No. 13/273,062, filed on Oct. 13, 2011, now abandoned, which is a continuation of application No. PCT/EP2010/054318, filed on Mar. 31, 2010.

(30) Foreign Application Priority Data

Apr. 15, 2009 (DE) ..... 10 2009 002 384

(51) Int. Cl.

| | |
|---|---|
| ***C11D 17/00*** | (2006.01) |
| ***C11D 3/50*** | (2006.01) |
| ***C11D 3/12*** | (2006.01) |
| ***C11D 3/37*** | (2006.01) |

(52) U.S. Cl.
CPC ..... *C11D 3/505* (2013.01); *C11D 3/1246* (2013.01); *C11D 3/3726* (2013.01); *C11D 17/0039* (2013.01)

(58) Field of Classification Search
None
See application file for complete search history.

(56) References Cited

U.S. PATENT DOCUMENTS

| | | | | |
|---|---|---|---|---|
| 6,369,020 | B1 * | 4/2002 | Kohlus | C11D 1/29 510/276 |
| 2003/0125222 | A1 | 7/2003 | Jahns et al. | |
| 2007/0138673 | A1 * | 6/2007 | Lee et al. | 264/4.1 |
| 2008/0119379 | A1 * | 5/2008 | Boerefijn et al. | 510/299 |

FOREIGN PATENT DOCUMENTS

| | | | |
|---|---|---|---|
| DE | 102008051799 | A1 | 4/2010 |
| WO | 93/13195 | A1 | 7/1993 |
| WO | 2007/099469 | A2 | 9/2007 |
| WO | 2009/101593 | A2 | 8/2009 |

OTHER PUBLICATIONS

PCT International Search Report (PCT/EP2010/054318) dated Jun. 28, 2010.

* cited by examiner

*Primary Examiner* — Brian Gulledge
(74) *Attorney, Agent, or Firm* — Thomas G. Krivulka

(57) ABSTRACT

A granular washing, cleaning or treatment agent additive, comprising 5 to 90 wt % of a particulate carrier material having an oil absorption capacity of at least 100 ml/100 g and 10 to 80 wt % of capsules in which one or more beneficial agents are enclosed, can be produced in that the particulate carrier material is fluidized, a pourable capsule preparation is applied to the carrier material, and the mixture thus obtained is granulated.

16 Claims, No Drawings

GRANULAR WASHING, CLEANING OR TREATMENT AGENT ADDITIVE

CROSS-REFERENCE TO RELATED APPLICATIONS

This application is a continuation of U.S. application Ser. No. 13/273,062, filed on Oct. 13, 2011, which is a continuation of PCT Application Serial No. PCT/EP2010/054318, filed on Mar. 31, 2010, which claims priority under 35 U.S.C. §119 to 10 2009 002 384.4 (DE), filed on Apr. 15, 2009. The disclosures PCT/EP2010/054318 and DE 10 2009 002 384.4 are hereby incorporated by reference in their entirety.

FIELD OF THE INVENTION

The invention relates to a granular washing, cleaning or treatment agent additive that contains beneficial additive capsules, a process for manufacturing such a granular washing, cleaning or treatment agent additive, the use of such an additive when finishing a particulate washing, cleaning or treatment agent as well as a washing, cleaning or treatment agent that comprises such an additive.

BACKGROUND OF THE INVENTION

Beneficial agents such as for example skin care or fabric care agents or perfume can be incorporated in liquid form into washing, cleaning or treatment agents, normally by spraying, or in solid form by blending the beneficial agent with the washing, cleaning or treatment agent or also with a component of the respective agent. Several disadvantages result from this procedure: The beneficial agent that makes up only a minor fraction of the ready-made washing, cleaning or treatment agent cannot be homogeneously blended with the other components of the washing, cleaning or treatment agent, such that the ready-made agent exhibits differing properties that depend on the amount of beneficial agent that is comprised in each considered batch (e.g. in the separate amount dosed by the consumer). If the beneficial agent is volatile, unstable to light or air or it reacts with the other components comprised in the washing, cleaning or treatment agent, then only a reduced amount of the beneficial agent remains available for the advantageous administration at the desired time. Furthermore, the decomposition products and reaction products of the beneficial agent or of the co-reactants can impair the performance of the washing, cleaning or treatment agent. If for example perfume is sprayed onto a washing, cleaning or treatment agent in a post addition step, then individual components of this perfume already volatilize as of this point in time; furthermore the danger exists that the perfume will decompose over time, for example due to the interaction with likewise comprised bleach compounds or surfactants. The perfume lends a pleasant smell to the washing, cleaning or treatment agent, as well as to the wash liquid, into which it is transferred during the washing, cleaning or treatment process, and in many cases for a short time even to the surfaces treated with the wash liquid. However, a longer term fragrance effect is not achieved, because the perfume fractions that actually remain on the treated surfaces after drying evaporate away.

The above disadvantages can be overcome by encapsulating one or more of the beneficial agents. However, the incorporation of encapsulated beneficial agents that in the manufacture of the capsules mostly involve a liquid liquid-capsule mixture—abb. capsule slurry—is very problematic for the person skilled in the art in washing, cleaning or treatment agents.

If the capsule slurry is sprayed on, then the problem arises that the frequently fragile capsules are unable to withstand the mechanical forces that occur during spraying, and consequently a considerable amount of capsule breakage and release of beneficial agent occur during the spraying process. The released beneficial agent can once more be destroyed or evaporate without hindrance and thereby is no longer available for advantageous administration at the intended time.

If, on the other hand, the capsule slurry is "heaped up" on the particulate material and, bearing in mind the fragility of the capsules, is blended in with low, or at most, average shear, then clumps are formed due to agglomeration, which also limits the free-flowability of the ready-made agent. At the microscopic level, capsule agglomerates are also formed which are combined with the carrier material (carrier agglomerates). Systems of this kind are characterized by the particularly poor resistance against mechanical forces, thereby again resulting in poor storage stability and transportability. The breakage of the capsules that are located on exposed positions on the carrier material also causes a premature release of the beneficial agent, which evaporates and/or reacts with light, air or other components thereby leading to discoloration, loss of performance and deterioration of the fragrance of the agent. If a capsule slurry is heaped onto particulate material, the liquid of the capsule slurry moreover partially dissolves or even dissolves the water-soluble components of the particulate materials, thereby destroying the powder structure of the washing, cleaning or treatment agent and leads to a clear deterioration of the appearance of the agent, to a reduction of its effectiveness as well as to a significant change in the bulk properties of the particulate product (bulk density, particle size distribution, flow properties). Even when the capsule slurry is "heaped on" or "run in", a homogeneous dispersion of the encapsulated beneficial agent in the finished made up washing, cleaning or treatment agent cannot be achieved.

If, prior to blending with the usual components of the washing, cleaning or treatment agent, the capsule slurry is dried, then in addition to the problem of the mechanical forces on the capsule there is also the problem of the exposure to heat, such that this processing possibility seems not to be suitable, especially for fragile capsules, as well as for capsules, whose shells and/or cores is/are unstable to heat.

Therefore there is a need to overcome some—preferably all—of the abovementioned disadvantages.

SUMMARY OF THE INVENTION

The subject matter of the present invention is generally a granular washing, cleaning or treatment agent additive containing 5 to 90 wt % of particulate carrier material having a defined oil-absorption capacity and mean diameter, in which one or more beneficial agents is/are incorporated.

DETAILED DESCRIPTION OF THE INVENTION

The present invention is a granular washing, cleaning or treatment agent additive containing 5 to 90 wt % of particulate carrier material having an oil-absorption capacity of at least 100 mL/100 g and 10 to 80 wt % capsules that have a mean diameter $d_{50}$ of 1 to 100 μm and in which one or more beneficial agents is/are incorporated.

The term "beneficial agent" is understood to include, inter alfa, fabric care compounds such as softeners, water proofing and impregnation agents against water and resoiling, bleaching agents, bleach activators, enzymes, silicone oils, anti-redeposition agents, optical brighteners, graying inhibitors, shrink inhibitors, anti-creasing agents, color transfer inhibitors, antimicrobials, germicides, fungicides, antioxidants, antistats, ironing auxiliaries, swelling and anti-slip agents, UV absorbers, cationic polymers; treatment agents for hard surfaces such as disinfectants, impregnation agents against water and resoiling, gloss promoters or inhibitors, hydrophobic or hydrophilic agents, film formers; skin care agents; or perfume (oils).

A "skin care compound" is understood to mean a compound or a mixture of compounds that on contact with a surface with the washing, cleaning or treatment agent is absorbed onto the surface and on contact of the surface with skin lends a benefit to the skin compared with a surface that was not treated with the washing, cleaning or treatment agent. This advantage can include for example the transfer of the skin care compound from the surface onto the skin, a lower water transfer from the skin to the fabric or a lower friction on the surface of the skin by the treated surface.

The skin care compound is preferably hydrophobic, can be liquid or solid and must be compatible with the other ingredients of the composition. The skin care compound can contain for example:

a) waxes such as carnauba, spermaceti, beeswax, lanolin, derivatives thereof as well as their mixtures;
b) plant extracts, for example vegetal oils such as avocado oil, olive oil, palm oil, palm nut oil, rape seed oil, linseed oil, soya oil, peanut oil, coriander oil, castor oil, poppyseed oil, coconut oil, pumpkin seed oil, wheat germ oil, sesame oil, sunflower oil, almond oil, macadamia nut oil, apricot nut oil, hazel nut oil, jojoba oil or canola oil, chamomile, aloe vera or also green tea extract or plankton extract as well as mixtures thereof;
c) higher fatty acids such as lauric acid, myristic acid, palmitic acid, stearic acid, behenic acid, oleic acid, linoleic acid, linolenic acid, isostearic acid or polyunsaturated fatty acids;
d) higher fatty alcohols such as lauryl alcohol, cetyl alcohol, stearyl alcohol, oleyl alcohol, behenyl alcohol or 2-hexadecanol;
e) esters, such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate or alkyl tartrate;
f) hydrocarbons such as paraffins, mineral oils, squalane or squalene;
g) lipids;
h) vitamins such as vitamin A, C or E or vitamin alkyl esters;
i) phospholipids;
j) sun protection agents such as octyl methoxylcinnamate and butyl methoxybenzoylmethane;
k) silicone oils such as linear or cyclic polydimethylsiloxanes, amino-, alkyl-, alkylaryl- or aryl-substituted silicone oils; and,
l) mixtures thereof.

Suitable perfume oil may comprise individual fragrant compounds, for example synthetic products of the ester, ether, aldehyde, ketone, alcohol, and hydrocarbon type. Fragrant compounds of the ester type are, for example, benzyl acetate, phenoxyethyl isobutyrate, p-tert-butylcyclohexyl acetate, linalyl acetate, dimethylbenzyl carbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate and jasmecyclate. The ethers include, for example, benzyl ethyl ether and ambroxan; the aldehydes include, for example, the linear alkanals containing 8 to 18 carbon atoms, citral, citronellal, citronellyloxyacetaldehyde, cyclamen aldehyde, lilial and bourgeonal; the ketones include, for example, the ionones, isomethyl ionone and methyl cedryl ketone; the alcohols include anethol, citronellol, eugenol, geraniol, linalool, phenylethyl alcohol and terpineol and the hydrocarbons include, for example the terpenes, such as limonene and pinene. However, mixtures of various fragrances, which together produce an attractive fragrant note of the resulting perfume oil, are preferably used.

The perfume oils may also contain natural mixtures of fragrances, as are obtainable from vegetal sources, for example pine, citrus, jasmine, patchouli, rose or ylang-ylang oil. Also suitable are e.g. muscatel sage oil, chamomile oil, clove oil, *melissa* oil, mint oil, cinnamon leaf oil, lime blossom oil, juniper berry oil, vetivert oil, olibanum oil, galbanum oil and laudanum oil and orange blossom oil, neroli oil, orange peel oil and sandalwood oil.

Exemplary tenacious fragrances are the ethereal oils such as *angelica* root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiacum wood oil, Indian wood oil, *helichrysum* oil, ho oil, ginger oil, iris oil, cajuput oil, sweet flag oil, chamomile oil, camphor oil, Canoga oil, cardamom oil, cassia oil, Scotch fir oil, copaiba balsam oil, coriander oil, spearmint oil, caraway oil, cumin oil, lavender oil, lemon grass oil, limette oil, mandarin oil, *melissa* oil, amber seed oil, myrrh oil, clove oil, neroli oil, niaouli oil, olibanum oil, orange oil, origanum oil, Palma Rosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil and cypress oil. However, in the context of the present invention, the higher boiling or solid fragrances of natural or synthetic origin can be advantageously used as tenacious fragrances or mixtures of fragrances. These compounds include for example the following compounds and their mixtures: ambrettolide, amyl cinnamaldehyde, anethol, anisaldehyde, anis alcohol, anisole, methyl anthranilate, acetophenone, benzyl acetone, benzaldehyde, ethyl benzoate, benzophenone, benzyl alcohol, borneol, bornyl acetate, bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarone, p-methoxyacetophenone, methyl n-amyl ketone, methyl anthranilic acid methyl ester, p-methylacetophenone, methyl chavicol, p-methylquinoline, methyl naphthyl ketone, methyl n-nonyl acetaldehyde, methyl n-nonyl ketone, muscone, naphthol ethyl ether, naphthol methyl ether, nerol, nitrobenzene, n-nonyl aldehyde, nonyl alcohol, n-octyl aldehyde, p-oxyacetophenone, pentadecanolide, phenyl ethyl alcohol, phenyl acetaldehyde dimethyl acetal, phenylacetic acid, pulegone, safrol, isoamyl salicylate, methyl salicylate, hexyl salicylate, cyclohexyl salicylate, santalol, scatol, terpineol, thymine, thymol, undecalactone, vanillin, veratrum aldehyde, cinnamaldehyde, cinnamyl alcohol, cinnamic acid, ethyl cinnamate, benzyl cinnamate. In the context of the present invention, the advantageously utilizable fragrances of higher volatility particularly include the lower boiling fragrances of natural or synthetic origin that can be used alone or in mixtures. Exemplary fragrances of higher volatility are alkyl isothiocyanates (alkyl mustard oils), butanedione, limonene, linalool, linalyl acetate and linalyl propionate, menthol, menthone, phellandrene, phenylacetaldehyde, terpinyl acetate, citral, citronellal.

In the context of an aroma therapeutic effect, ethereal oils can also be inventively used as the beneficial agent. Exemplary preferred ethereal oils are *angelica fine—angelica archangelica*, aniseed—*pimpinella anisum*, benzoe siam—*styrax tokinensis*, cabreuva—*myrocarpus fastigiatus*, cajeput—*melaleuca leucadendron*, cistrose—*cistrus ladaniferus*, copaiba-balsam—*copaifera reticulata*, costic root—*saussurea discolor*, silver fir needle—*abies alba*, elemi—*canarium luzonicum*, fennel—*foeniculum dulce* pine-needle—*picea abies, geranium—pelargonium graveolens*, ho-leaves—*cinnamonum camphora*, immortals (straw flower) *helichrysum* ang., ginger—*zingiber off*, St. John's wort—*hypericum perforatum, jojoba*, German chamomile—*matricaria recutita*, chamomile oil blue—*matricaria chamomilla*, Roman chamomile—*anthemis nobilis*, wild chamomile—*ormensis multicaulis*, carrot—*daucus carota*, knee pine—*pinus mugho*, lavander—*lavendula hybrida*, litsea cubeba—(may chang), manuca—*leptospermum scoparium*, balm mint—*melissa officinalis*, pine tree—*pinus pinaster*, myrrh—*commiphora molmol*, myrtle—*myrtus communis*, neem—*azadirachta*, niaouli—(mqv) *melaleuca quin. viridiflora*, palmarosa—*cymbopogom martini*, patchouli—*pogostemon patschuli*, perubalsam—*myroxylon balsamum* var. *pereirae, raventsara aromatica*, rose wood—*aniba rosae* odora, sage—*salvia officinalis* horsetail—equisetaceae, yarrow—*achillea millefolia*, narrow leaf plantain—*plantago lanceolata, styrax—liquidambar orientalis, tagetes* (marigold) *tagetes patula*, tea tree—*melaleuca alternifolia*, tolubalsam—*myroxylon balsamum* l., virginia-ceder—*juniperus virginiana*, frankincense (olibanum)—*boswellia carteri*, silver fir—*abies alba*. The use of ethereal oils corresponds to a preferred embodiment of the invention.

As has already been suggested, a capsule can comprise a single or also a mixture of a plurality of beneficial agents. For example, it is preferred that a capsule comprises perfume as the beneficial agent, optionally in a mixture with a skin care agent. A capsule comprising a plurality of fabric softeners is also conceivable. Furthermore, it is also possible for an inventive washing, cleaning or treatment agent additive to comprise various beneficial agent-containing capsules.

In the context of the present invention, capsules are composed of at least one shell and a core. In this regard the core can be solid, liquid or viscous or exist as a melt and possess a waxy structure. Capsules, which comprise essentially pure beneficial agent(s), as well as capsules, in which the core is formed by a carrier that is blended with or impregnated with a beneficial agent, are both conceivable. In the context of the present invention, the core of the capsules is preferably liquid, viscous or at least meltable at temperatures below 120° C., preferably below 80° C. and especially below 40° C.

In the context of the present invention, suitable capsules are those that have a mean diameter $d_{50}$ of 1 to 100 μm, preferably 5 to 80 μm, particularly preferably 10 to 50 μm and especially 15 to 40 μm. Here, the $d_{50}$ value indicates the diameter, which results when 50 wt % of the capsules have a diameter less than, and 50 wt % of the capsules have a diameter more than, the measured $d_{50}$ value.

Capsules that have a mechanically stable capsule shell can be used, as long as the capsule shell is permeable to the beneficial agent(s) due to one or more other mechanisms, such as temperature changes or changes in ion strength or changes in pH of the surrounding medium. Stable capsule wall materials, through which the beneficial agent(s) can diffuse over time, are also conceivable. The capsules release the comprised beneficial agent preferably by changes in the pH or ion strength of the surroundings, by changes in temperature, by the effect of light, by diffusion and/or by mechanical forces.

In a preferred embodiment of the present invention, the capsules are fragile, i.e. they release enclosed beneficial agent following mechanical forces such as rubbing, pressure or shear forces. Advantageously, a pressure of less than 10 pound per square inch (psi), preferably less than 5 psi and especially less than 1 psi on a capsule causes the release of the comprised beneficial agent.

In another preferred embodiment, the capsule is thermally unstable, i.e. enclosed beneficial agents are released when the capsules are exposed to a temperature of at least 70° C., advantageously at least 60° C., preferably at least 50° C., and especially at least 40° C.

In a further preferred embodiment, the capsule, after the action of waves of a certain wavelength, becomes permeable to the enclosed beneficial agent, preferably by the action of sunlight.

It is also conceivable for the capsules to be fragile and concomitantly unstable towards heat and/or unstable towards waves of a certain wavelength.

The inventively usable capsules can be water-soluble and/or water-insoluble capsules. However, they are preferably water-insoluble capsules. The water-insolubility of the capsules is advantageous as this enables them to survive the washing, cleaning or treatment application, with the result that the beneficial agent is released only after the aqueous washing, cleaning or treatment process—for example in the drying step merely due to increased temperature or due to solar radiation or due to rubbing of the surface.

Particularly preferably the water-insoluble capsules can be worn down, wherein the wall material preferably includes polyurethanes, polyolefins, polyamides, polyesters, polysaccharides, epoxy resins, silicone resins and/or polycondensation products of carbonyl compounds and compounds that comprise NH groups.

The term "capsules that can be worn down" means those capsules that when they adhere to a surface that has been treated with them, can be opened or worn down by mechanical rubbing or by pressure, such that the contents are released only as a result of a mechanical action, for example when one dries one's hands with a towel, onto which such capsules have been deposited. Preferred useable capsules have a mean diameter $d_{50}$ in the range 1 to 100 μm, preferably between 5 and 95 μm, especially between 10 and 90 μm, e.g. between 10 and 80 μm. The shell that encloses the core or the (filled) cavity of the capsules has an average thickness in the range between 0.01 and 50 μm, preferably between about 0.1 μm and about 30 μm, especially between about 0.5 μm and about 8 μm. Capsules can be particularly well worn down when their mean diameters and average thicknesses are in the previously cited ranges.

Usually high molecular weight compounds can be considered for materials for the capsules; they include for example albuminous compounds (e.g. gelatins, albumin, casein and others), cellulose derivatives (e.g. methyl cellulose, ethyl cellulose, cellulose acetate, cellulose nitrate, carboxymethyl cellulose and others) as well as above all synthetic polymers (e.g.

polyamides, polyethylene glycols, polyurethanes, epoxy resins and others). Preferably, melamin-urea-formaldehyde capsules or melamin-formaldehyde capsules or urea-formaldehyde capsules can be employed, for example. Those capsules that are described in US 20030125222 A1 or DE 102008051799.2 (unpublished) are particularly preferably inventively employed.

In addition to the capsules, the inventive washing, cleaning or treatment agent additive comprises particulate carrier material, which can be a single particulate component or also a mixture of a plurality of different particulate components. It is important, however, that the sum of all the particulate components that are comprised in the inventive washing, cleaning or treatment agent additive exhibits an oil absorption capacity of at least 100 mL/100 g in the dry state (after heating at 150° C. for one hour).

In the context of the present invention, materials that have very good absorption properties are suitable as the carrier materials. The oil absorption capacity, determined according to the ISO 787-5 standard, can serve as a measure for the absorption properties of the materials. According to this method a sample quantity of the particulate material under investigation is placed onto a plaque. From a burette, 4 or 5 drops of refined linseed oil is slowly dropped all at once and after each addition the oil is rubbed into the particulate material with a sharp spatula. The oil is continuously added until agglomerates of solids and oil have formed. From this point on each drop is added and after each addition of oil it is thoroughly rubbed in with the sharp spatula. When a soft paste is obtained, the addition of oil is terminated. The paste should still be able—without breaking or crumbling—to be divided and still adhere to the plaque. The oil absorption capacity is expressed in mL oil per 100 g sample.

The carrier material preferably exhibits an oil absorption capacity (quantified according to the standard ISO 787-5) of at least 125 mL/100 g, preferably at least 150 mL/100 g, particularly preferably at least 175 mL/100 g and particularly at least 200 mL/100 g.

The BET surface (according to DIN 66131) of the carrier material, independently of the value of the oil absorption capacity, is advantageously at least 10 $m^2/g$, preferably at least 40 $m^2/g$, particularly preferably at least 70 $m^2/g$, with preference to this at least 100 $m^2/g$ and especially at least 130 $m^2/g$.

The mean particle size $d_{50}$ of the carrier material is advantageously below 100 μm, preferably below 75 μm, more preferably below 50 μm, in preference to this below 25 μm, preferably below 18 μm and especially below 10 μm.

The carrier material preferably comprises amorphous aluminosilicates. These are understood to mean amorphous compounds containing different contents of aluminum oxide ($Al_2O_3$) and silicon dioxide ($SiO_2$) and which comprise additional metals. Preferably, the amorphous aluminosilicate employed in the inventive process can be described by one of the Formulas (I) or (II) below.

In Formula (I), M stands for an alkali metal, preferably sodium or potassium. Particularly preferably, x assumes values of 0.2 to 2.0, y the values 0.5 to 10.0 and w all positive values including 0:

$$x(M_2O)Al_2O_3y(SiO_2)w(H_2O) \quad (I)$$

In Formula (II), Me stands for an alkaline earth metal, M for an alkali metal, and preferably x for values of 0.001 to 0.1, y for values 0.2 to 2.0, z for values 0.5 to 10.0 and w for positive values including 0:

$$x(MeO)y(M_2O)Al_2O_3z(SiO_2)w(H_2O) \quad (II)$$

Furthermore, instead of the amorphous aluminosilicates or in addition to these clays, the carrier material can include preferably bentonite, alkaline earth metal silicates, preferably calcium silicate, alkaline earth metal carbonates, especially calcium carbonate and/or magnesium carbonate and/or silica.

The carrier material particularly preferably comprises silicas, wherein the term silica stands here as a collective term for compounds of the general formula $(SiO_2)_m.nH_2O$. Precipitated silicas are manufactured from an aqueous alkali metal silicate solution by precipitation with mineral acids. This leads to the formation of primary particles that agglomerate as the reaction proceeds and finally coalesce into aggregates. The powdery, voluminous forms have a BET surface from 30 to 800 $m^2/g$.

Highly dispersed silicas, manufactured by flame hydrolysis, are summarized by the designation pyrogenic silicas. Here, silicon tetrachloride is decomposed in an oxyhydrogen flame. Pyrogenic silicas have significantly less OH groups on their surface than do precipitated silicas. Due to the hydrophilic character afforded by the silanol groups, the synthetic silicas are frequently subjected to chemical treatment processes, in which the OH groups react with e.g. organic chlorosilanes. This results in modified, e.g. hydrophobic surfaces, which considerably extend the industrial applicability of the silicas. In the context of the present invention, chemically modified silicas are also included under the term "silicas".

In this regard, Sipernat® 22 S, Sipernat® 50 or Sipernat® 50 S from Evonik (Germany), spray dried and subsequently particularly ground silicas illustrate particularly advantageous embodiments, as these have proved to be very absorbent. However, other silicas from the prior art are also likewise preferred.

The granular washing, cleaning or treatment agent additive preferably comprises 10 to 80 wt %, preferably 12.5 to 70 wt %, particularly preferably 15 to 60 wt % and in particular 17.5 to 50 wt % of particulate carrier material.

Due to the difficulties associated with the preparation of agents by adding capsule slurries, described in the definition of the problem, an inventive washing, cleaning or treatment agent additive or the carrier material preferably contains only minor amounts of particulate, water-soluble components. The washing, cleaning or treatment agent additive and/or the carrier material preferably comprise less than 20 wt %, preferably less than 15 wt %, particularly preferably less than 10 wt % and especially less than 5 wt % of particulate, water-soluble components. As minor amounts of water-soluble components in dissolved form can be brought into the washing, cleaning or treatment agent additive from the capsule slurry, the absorbent carrier material can withdraw the water and thereby consolidate the water-soluble components, the carrier material preferably comprises less than 4 wt %, preferably less than 3 wt % and particularly less than 2 wt % of water-soluble components. It has been found that washing, cleaning or treatment agent additives that comprise minor amounts of particulate water-soluble components, respectively whose carrier material comprises minor amounts of water-soluble components, have an improved free-flowability and can be homogeneously blended into a greater amount of particulate components—for example in a washing, cleaning or treatment agent in the post addition step. Moreover, the additive as well as the finished product resulting therefrom exhibits a markedly lower tendency to segregation.

Nevertheless, it has proven particularly advantageous when the granular washing, cleaning or treatment agent additive comprises ammonium carbonate and/or ammonium hydrogen carbonate. The granular washing, cleaning or treatment agent additive preferably comprises at least 0.05 wt %, but less than 20 wt %, preferably less than 10 wt %, more advantageously less than 5 wt %, more preferably 1 to 2 wt % and especially from 0.1 to 1.5 wt % ammonium carbonate and/or ammonium hydrogen carbonate.

The ammonium carbonate, and/or ammonium hydrogen carbonate, containing granular washing, cleaning or treatment agent additives enable a stable incorporation of capsules, especially of micro-capsules, into the powder matrix of the granular washing, cleaning or treatment agent. The granular washing, cleaning or treatment agent additives as such are storage stable and once again afford storage stable granular washing, cleaning or treatment agents. The resulting washing, cleaning or treatment agent additives, even in the presence of particularly fragile capsules, can be handled without any problem (i.e. pouring, storage and further processing). The very good storage behavior and transportability of the granular washing, cleaning or treatment agent additive allows the additive to be blended as needed into selected formulations, thereby extending the packaging possibilities for granular washing, cleaning and treatment agent finished products.

Furthermore, the granular washing, cleaning or treatment agent additive according to the invention preferably comprises less than 10 wt %, advantageously less than 8 wt %, preferably less than 6 wt % and in particular less than 4 wt % surfactant. It was surprisingly found that these surfactant-poor additives have an improved smell and an improved color effect than comparable surfactant-rich additives.

The washing, cleaning or treatment agent additive according to the invention is granular in form. In this regard, the capsules and the carrier material in the additive are preferably so homogeneously dispersed that on average less than 60 wt %, preferably less than 45 wt % and in particular less than 30 wt % of the capsules comprised in a washing, cleaning or treatment agent additive granule grain are located on the surface of the grain. The result is that this preferred additive granule does not resemble a carrier material particle coated with capsules, or resemble capsule agglomerates fixed on carrier material particles. It was found that a washing, cleaning or treatment agent additive, in which carrier material and capsules are so homogeneously dispersed that on average less than 60 wt % of the capsules comprised in a washing, cleaning or treatment agent additive granule grain are located on the surface of the individual grains, is more stable towards mechanical influences than a comparable additive in which the capsules are located to a greater degree on the surface of the grains, such as when capsules form a coating on each grain or fixed as agglomerates on the granule surface. The additive according to the invention exhibits an improved storage and transportability, with the result that less beneficial agent is released prior to the intended time, as with an additive in which the capsules are located to a greater degree on the surface of the grains.

The granular washing, cleaning or treatment agent additive comprises at least 16 wt %, preferably at least 24 wt %, particularly preferably at least 32 wt % and especially at least 40 wt % of a component that is liquid at 20° C. and 1 bar. This component preferably consists to at least 50 wt %, particularly preferably to at least 70 wt %, with preference to at least 90 wt % and especially to at least 95 wt % of water, based on the liquid component.

In a preferred embodiment this liquid originates from the capsule slurry. This liquid does not need to be removed during the manufacture of the inventive additive, as the additive according to the invention exhibits good free flowability in spite of the high liquid content. This has the advantage that the inventive additive does not have to be dried in order to remove the liquid which—in comparison with the present invention—is associated with avoidable mechanical and thermal stresses and leads to the unwanted release of the beneficial agent prior to the intended time.

The bulk density of the granular washing, cleaning or treatment agent additive is preferably 400 to 1200 g/L, preferably 500 to 1000 g/L, particularly preferably 600 to 900 g/L and especially 700 to 850 g/L.

Another subject matter of the present invention is a process for manufacturing a granular washing, cleaning or treatment agent additive comprising the following steps:

a) the fluidization of particulate carrier material having an oil absorption capacity of at least 100 mL/100 g;

b) depositing a pourable capsule preparation that comprises 20-75 wt % capsules and 25-80 wt % of a component that is liquid at 20° C. and 1 bar onto the carrier material; and, c) granulating the resulting mixture.

The above described washing, cleaning or treatment agent additive can be manufactured by means of this process. The herein described embodiments for carrier material, capsule materials and their properties, beneficial agents, and the granular washing, cleaning or treatment agent additive, also apply to the inventive process for manufacturing the additive. In order to avoid the need to repeat the relevant portions of the specification, reference is made to the corresponding passages above.

A "pourable capsule preparation" is understood to mean a capsule-liquid mixture that exhibits a viscosity of less than $10\text{-}10^4$ mPa-s$^{-1}$ (Brookfield spindle 2; 20 rpm) at the processing temperature, preferably at max. 40° C., especially at max. 20° C.

The component that is liquid at 20° C. and 1 bar, and comprised in the pourable capsule preparation, is preferably water. However, it may also be a mixture of two or more components, whose mixture is liquid at 20° C. and 1 bar, added as the "component that is liquid at 20° C. and 1 bar". Mixtures containing water and non-ionic surfactant that are liquid at 20° C. and 1 bar preferably form the "component that is liquid at 20° C. and 1 bar" of the pourable capsule preparation employed in the inventive process.

In the process, 10 to 95 wt %, preferably 30 to 93 wt % and especially 50 to 90 wt % of the pourable capsule preparation are preferably processed with 5 to 90 wt %, preferably 7 to 70 wt % and especially 10 to 50 wt % carrier material.

In the inventive process, the pourable capsule preparation is preferably not sprayed, but rather deposited onto the carrier material particularly by being "poured on". Particularly with fragile capsules or those that can be worn down, in the course of the process less beneficial agent is thus released prior to the intended time.

Optionally, subsequent to step c) of the inventive process, additional steps can be carried out such as removing the component that is liquid at 20° C. and 1 bar (drying) and which was incorporated in step b) in the process, maturation, rounding off, powdering with flow auxiliaries, spraying liquid or blending with particulate components and/or mixing in the product into liquid, viscous or particulate washing, cleaning or treatment agents. It is also possible to compress the washing, cleaning or treatment agent additive itself or in a mixture with additional components to form a tablet or the phase of a multi-layer tablet.

Excellent powder/granule properties of the washing, cleaning or treatment agent additive that was manufactured by means of the inventive process are obtained when high shear granulation is carried out in step c) of the process. Washing, cleaning or treatment agent additives that were manufactured according to a comparable process, but with lower or at most moderate shear in step c), are significantly inferior to the additives granulated under high shear in regard to flowability, free-flowability and especially in the homogeneity of the dispersion of the ingredients comprised within the granule.

The shear in a granulation process can be described by means of the Froude number. In the inventive process the Froude number of the mixing tools of the employed mixer/granulator is preferably at least 0.01, preferably at least 1, particularly preferably at least 1.5, more preferably at least 2 and especially at least 4.

The inventive process can be carried out in a mixer or also in a combination of a plurality of mixers. In the process, a mixer is preferably employed, in which mixing and cutting tools are comprised and which can be controlled independently of each other. In this regard, the Froude number of the cutting tool(s) is preferably at least 5, preferably at least 10, particularly preferably at least 15 and especially at least 20.

In a preferred embodiment of the inventive process, ammonium carbonate and/or ammonium hydrogen carbonate is additionally added. The ammonium carbonate and/or ammonium hydrogen carbonate can be added before, during and/or after the addition of the capsule dispersion, especially during the granulation. The ammonium carbonate and/or ammonium hydrogen carbonate can also be added directly into the micro-capsule dispersion.

The resulting granular washing, cleaning or care agent additives enable—as already described above—a stable incorporation and unproblematic handling and good storage stability of the resulting product, even in the case of particularly fragile capsules.

Based on the total amount of the particulate carrier material, capsule dispersion as well as ammonium carbonate and/or ammonium hydrogen carbonate, the ammonium carbonate and/or ammonium hydrogen carbonate is preferably added in a total quantity of <10 wt %, preferably <5 wt %, advantageously 0.05 to 2 wt %, especially from 0.1 to 1.5 wt %.

During or at the end of the process preferably less than 30 wt %, preferably less than 20 wt % and in particular less than 10 wt % of the component that is liquid at 20° C. and 1 bar are removed by drying. Less than 25 wt %, particularly preferably less than 15 wt % and especially less than 5 wt % of water are preferably removed at the end of the process. It was found that the resulting washing, cleaning or treatment agent additive exhibits good free-flowability in spite of the high moisture content. This has the advantage that the additive, manufactured by means of the inventive process, does not have to be dried in order to remove the liquid, which—in comparison with the present invention—is associated with avoidable mechanical and thermal stresses and leads to the unwanted release of the beneficial agent prior to the intended time.

As already described for the preferred embodiments of the inventive washing, cleaning or treatment agent additive, the carrier material that is preferably employed in the inventive process comprises less than 20 wt %, preferably less than 15 wt %, particularly preferably less than 10 wt % and especially less than 5 wt %, more preferably less than 4 wt %, preferably less than 3 wt % and especially less than 2 wt % of water-soluble components. It has been found that washing, cleaning or treatment agent additives, whose carrier material comprises minor amounts of water-soluble components, exhibit an improved free-flowability and can be homogeneously blended in a greater amount of particulate components—for example in a washing, cleaning or treatment agent in the post addition step than is the case when the carrier material contains greater amounts of water-soluble components. In addition, the inventively manufactured additive as well as the finished product resulting therefrom, exhibits a lower tendency to segregation.

In contrast to processes, in which a pourable capsule preparation (or also a capsule slurry) is added—for example in the post addition—to a washing, cleaning or treatment agent formulation or to a ready-made compound that comprises non-negligible amounts of bleach compounds, surfactants and/or other reactive components, the inventive process has the advantage that, even in the presence of fragile capsules, storage-stable products are obtained, which demonstrate neither deterioration of the color and odor impression nor of the free-flowability after refilling, storage and further processing (i.e. involving mechanical stresses and time).

The increased storage stability and transportability of the inventive or of the inventively manufactured granular washing, cleaning or treatment agent additive additionally enables the additive to be mixed as needed with selected formulations and thereby extends the packaging possibilities for washing, cleaning and treatment agent products.

As the inventive or the inventively manufactured granular washing, cleaning or treatment agent additive has a low tendency to segregation, it is possible to meter in the additive during the post addition without the need for significant complex equipment, whereas in comparison to this, in the case of spraying or feeding a capsule slurry in the post addition, the capsule slurry firstly needs to be "stirred up" so that it can be homogenized. This obviates the need for cost-intensive equipment that requires extensive space.

It is additionally advantageous that essentially no contamination of the post-addition mixing equipment occurs from blending in the granular washing, cleaning or treatment additive. In contrast, if a capsule slurry is sprayed on or metered in, then the capsule slurry cakes onto container walls and metering equipment, thus requiring increased cleaning efforts and consequently leads to losses of the beneficial agent.

Another subject matter of the present invention is the use of the inventive or of the inventively manufactured granular washing, cleaning or treatment agent additive for making up a particulate washing, cleaning or treatment agent.

In this regard, it is also possible to add the washing, cleaning or treatment agent additive at various points/times of the make up process of the respective finished agent. However, it is also conceivable to leave the final make up of the finished agent to the consumer, in that one makes available to him/her a plurality of washing, cleaning or treatment agent additives with different beneficial agents as well as a washing, cleaning or treatment basis agent and the consumer mixes the respective required washing, cleaning or treatment agent in a similar way as operating a modular construction system.

Another subject matter of the present invention is a washing, cleaning or treatment agent containing up to 10 wt %, preferably up to 7 wt %, more preferably up to 4 wt % and especially up to 1 wt % of one or more inventive or inventively manufactured washing, cleaning or treatment agent additives.

If a plurality of inventive or inventively manufactured washing, cleaning or treatment agent additives are comprised in the above washing, cleaning or treatment agent, then the above quantity ranges indicate the sum of the comprised inventive or inventively manufactured washing, cleaning or treatment agent additives.

In addition to the inventive or inventively manufactured washing, cleaning or treatment agent additives the washing, cleaning or treatment agent preferably comprises one or more additional ingredients, preferably from the group of the builders, surfactants, polymers, bleaching agents, bleach activators, bleach catalysts, enzymes, disintegration aids, fragrances, perfume carriers, colorants, electrolytes, pH adjustors, fluorescence agents, hydrotropes, foam inhibitors, silicone oils, antiredeposition agents, optical brighteners, anti-graying inhibitors, shrink preventers, anti-creasing agents, color-transfer inhibitors, antimicrobials, germicides, fungicides, antioxidants, antistats, ironing auxiliaries, waterproofing and impregnation agents, swelling and non-slip agents as well as UV-absorbers.

The washing, cleaning or treatment agent can be in solid form, for example as a granule or tablet, or in liquid to viscous/gel-like form.

A preferred embodiment of the present invention is a washing, cleaning or treatment agent in particulate form ("the particle") that contains at least one inventive or inventively manufactured washing, cleaning or treatment agent additive as well as in addition water-soluble or water-dispersible carrier particles.

Accordingly a further subject matter of the present invention is a treatment agent comprising:

a) water-soluble or water-dispersible, particulate carrier particles with a mean particle size $d_{50}$=0.1 to 3 cm; and,
b) 5 to 70 wt % of one or more washing, cleaning or treatment agent additives as described previously.

If the water-soluble or water-dispersible carrier particles contain material(s), selected from inorganic salts of alkali metals, organic salts of alkali metals, inorganic salts of alkaline earth metals, organic salts of alkaline earth metals, organic acids, carbohydrates, silicates, urea or mixtures thereof, then this is a preferred embodiment of the invention.

Suitable materials are for example inorganic salts of alkali metals such as for example sodium chloride, potassium chloride, sodium sulfate, sodium carbonate, potassium sulfate, potassium carbonate, sodium hydrogen carbonate, potassium hydrogen carbonate or mixtures thereof, organic salts of alkali metals such as for example sodium acetate, potassium acetate, sodium citrate, sodium tartrate or potassium sodium tartrate, inorganic salts of alkaline earth metals such as for example calcium chloride, magnesium sulfate or magnesium chloride, organic salts of alkaline earth metals such as for example calcium lactate, carbohydrates, organic acids such as for example citric acid or tartaric acid, silicates such as for example water glass, sodium silicate or potassium silicate, urea as well as mixtures thereof.

Particularly preferred water-soluble or water-dispersible carrier particles include carbohydrates, however. Accordingly, if the water-soluble or water-dispersible carrier particle contains a carbohydrate, in particular selected from dextrose, fructose, galactose, isoglucose, glucose, saccharose, raffinose or mixtures thereof, then this also constitutes a preferred embodiment of the invention. It is particularly advantageous if the added water-soluble or water-dispersible carrier particle is based on at least 80 wt %, preferably at least 90 wt %, especially at least 95 wt % or even completely on carbohydrates.

The carbohydrate that can be added can be for example candy sugar or coarse sugar. The use of crystalline sugar affords esthetically particularly appealing particles with increased consumer acceptance.

According to a preferred embodiment of the invention, the particles are characterized in that the carrier particle is in the form of crystals.

The water-soluble or water-dispersible carrier particle can also comprise mixtures of the cited materials. That is, for example, mixtures of salts such as sodium citrate and carbohydrates.

In another preferred embodiment, the fraction of the water-soluble or water-dispersible carrier particle is 50 to 99 wt %, preferably 75 to 95 wt %, based on the total particle.

It is particularly preferred when a particle is characterized in that the water-soluble or water-dispersible carrier particle is coated with a mixture that contains thermoplastic polymer and capsules. A suitable exemplary development is one, in which the particle core is formed from the water-soluble or water-dispersible carrier particle, wherein the core is coated with thermoplastic polymer and inventive or inventively manufactured granular washing, cleaning or treatment agent additive.

It is preferred that a particle, in particular a particle coated with thermoplastic polymer and inventive or inventively manufactured granular washing, cleaning or treatment agent additive, is additionally powdered with a powdered agent, in particular containing zeolite, silica, fabric softening clay (e.g. bentonite), starch and/or their derivatives and/or cellulose (derivatives) such as preferably carboxymethyl cellulose.

Alternatively, it is preferred that the inventive or inventively manufactured granular washing, cleaning or treatment agent additive is employed as the powdered agent when the particle is manufactured and thus forms an additional layer above the particle core made of carrier particle and the first layer that contains thermoplastic polymer and optionally perfume, colorant and additional components.

A preferred inventive particle is characterized in that the water-soluble or water-dispersible carrier particle has a particle size in the range 0.1 to 30 mm, especially 0.2 to 7 mm and particularly preferably 0.5 to 3 mm, e.g. in the range 0.8 to 2.5 mm.

The particle as such can have a particle size in the range >0.1 to 30 mm, preferably 0.2 to 10 mm, in particular >0.5 to 5 mm, e.g. in the range 0.8 to 3 mm.

In order to improve the esthetic impression of the particles, they may be colored with appropriate colorants. An inventive particle can also comprise a pearlizer for increasing the gloss. Exemplary suitable pearlizers are ethylene glycol mono and distearate (for example Cutina® AGS from Cognis) as well as PEG-3-distearate.

The bulk density of the particles of the present invention is preferably in the range 300 to 900 g/L or 400 to 800 g/L, for example close to 700 g/L.

An exemplary embodiment of the present invention is shown in TABLE 1.

TABLE 1

Exemplary Granular Additive Composition

| Ingredient | Wt. % | |
|---|---|---|
| Silica (oil absorption capacity 255 mL/100 g) | 19.7 | |
| Friable melamin-urea-formaldehyde capsules with perfume oil core | 34.4 | |
| Water | 42.3 | |
| Nonionic surfactant | 3.6 | |
| Bulk Density | 643 g/L | |
| Particle Size Distribution | 2.0 mm | 1 wt % |
| | 1.6 mm | 5 wt % |
| | 1.25 mm | 10 wt % |
| | 0.8 mm | 32 wt % |
| | 0.6 mm | 30 wt % |
| | 0.4 mm | 18 wt % |
| | 0.2 mm | 3 wt % |
| | 0.1 mm | 1 wt % |
| | <0.1 mm | 0 wt % |

The granular additive granule can be incorporated in washing, cleaning and treatment agent formulations and on rubbing against washing treated with a leachate of the granule shows a perfume boosting effect.

We claim:

1. A granular washing, cleaning or treatment agent additive comprising:

a) from 5 to 90 wt. % of a particulate carrier material, said carrier material having an oil-absorption capacity of at least 100 mL/100 g;

b) from 10 to 80 wt. % of water-insoluble capsules having a mean diameter d50 from 1 to 100 μm;

c) at least one beneficial agent releasably enclosed in said capsules; and d) at least 16 wt. % of a component that is liquid at 20° C. and 1 bar, said liquid comprising at least 50% water based on the wt. of the liquid;

e) from 0.05 wt. % to less than 10 wt. % of ammonium carbonate and/or ammonium hydrogen carbonate;

wherein said granular washing, cleaning or treatment agent additive has a bulk density from 400 to 1200 g/L, and contains less than 10 wt. % particulate water-soluble components, and wherein the particulate carrier material comprises less than 4 wt. % of water-soluble components.

2. The granular washing, cleaning or treatment agent additive of claim 1, wherein said particulate carrier material is present from 10 to 80 wt. %.

3. The granular washing, cleaning or treatment agent additive of claim 2, wherein said particulate carrier material is present from 17.5 to 50 wt. %.

4. The granular washing, cleaning or treatment agent additive of claim 1, wherein said capsules release said beneficial agent upon exposure of the capsules to a condition selected from the group consisting of changes in the pH of the surroundings, changes in temperature, exposure to light, diffusion, and mechanical forces.

5. The granular washing, cleaning or treatment agent additive of claim 1, wherein said particulate carrier material has an oil-absorption capacity of at least 150 mL/100 g.

6. The granular washing, cleaning or treatment agent additive of claim 5, wherein said particulate carrier material has an oil-absorption capacity of at least 200 mL/100 g.

7. The granular washing, cleaning or treatment agent additive of claim 1, wherein less than 60 wt. % of said capsules reside on the surface of any granule of said granular agent.

8. The granular washing, cleaning or treatment agent additive of claim 7, wherein less than 30 wt. % of said capsules reside on the surface of any granule of said granular agent.

9. The granular washing, cleaning or treatment agent additive of claim 1 further comprising at least 16 wt. % water.

10. The granular washing, cleaning or treatment agent additive of claim 9, wherein said water is present at least at 40 wt. %.

11. The granular washing, cleaning or treatment agent additive of claim 1 further comprising a surfactant.

12. The granular washing, cleaning or treatment agent additive of claim 11, wherein said surfactant is present at less than 10 wt. %.

13. A process for manufacturing the granular agent of claim 1, said method comprising the steps of:

a) fluidizing said particular carrier material;

b) depositing a pourable capsule mixture comprised of said capsules and said component that is liquid at 20° C. and 1 bar, said capsules releasably enclosing said beneficial agent; and c) granulating the resulting mixture.

14. The process of claim 13, wherein said pourable capsule mixture is not sprayed.

15. The process of claim 13 further including a drying step during or at the end of said process, wherein less than 30 wt. % of said component that is liquid at 20° C. and 1 bar is removed in said drying step.

16. The process of claim 13, wherein said mixture is granulated with high shear.

* * * * *